US006800825B1

(12) United States Patent
Sasaki et al.

(10) Patent No.: US 6,800,825 B1
(45) Date of Patent: Oct. 5, 2004

(54) SWITCH DEVICE

(75) Inventors: Makoto Sasaki, Miyagi-ken (JP); Kenji Sawada, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/627,340

(22) Filed: Jul. 25, 2003

(30) Foreign Application Priority Data

Jul. 30, 2002 (JP) ..... 2002-221400

(51) Int. Cl.[7] ..... H01H 5/00

(52) U.S. Cl. ..... 200/402; 200/6 R; 200/339; 200/553

(58) Field of Search ..... 200/6 R, 6 C, 200/401, 402, 449, 553, 559, 224, 290, 339

(56) References Cited

U.S. PATENT DOCUMENTS 4,230,917 A * 10/1980 Osika ..... 200/43.01
4,947,008 A * 8/1990 Sato et al. ..... 200/6 R
5,265,716 A 11/1993 Sawada et al.
5,769,209 A * 6/1998 Massey, III ..... 200/339
6,040,543 A * 3/2000 Mina et al. ..... 200/559
6,175,090 B1 * 1/2001 Blossfeld ..... 200/558
6,399,908 B1 * 6/2002 Mueller et al. ..... 200/249

* cited by examiner

*Primary Examiner*—Kyung Lee
(74) *Attorney, Agent, or Firm*—Brinks Hofer Gilson & Lione

(57) ABSTRACT

A switch device includes two switch elements, both elements being disposed in a case and given restoring force by a common leaf spring; a cover which closes a top opening of the case; and an operating knob having two projections for selectively activating the switching elements. The leaf spring includes a compressed portion which is resiliently compressed by the cover, a pair of pressing strips which resiliently presses against each shaft of a pair of drivers of the switching elements. The operating knob presses a protruding receiver of each of the drivers, thereby selectively tilting a pair of conductive plates to output a switch ON signal.

4 Claims, 7 Drawing Sheets

SWITCH DEVICE

BACKGROUND OF THE INVENTION

1. Field of the Invention

The present invention relates to switch devices that are operated with a tilting movement by using, for example, an operating knob. In particular, the present invention relates to a switch device that tilts a conductive plate to move into and out of contact with stationary contacts to switch between ON and OFF modes. Such switch device are used as a driving switch for an automatic window unit in a vehicle.

2. Description of the Related Art

FIG. 9 is a sectional view of a conventional switch device. As is shown in FIG. 9, a case 1 includes a bottom wall 1*a* on which a first stationary contact 2*a*, a second stationary contact 2*b*, and a third stationary contact 2*c* are fixed by insert molding; and three terminals 8 which extend from the stationary contacts 2*a*, 2*b*, and 2*c* and protrude downward from the case 1. The stationary contacts 2*a*, 2*b*, and 2*c* are exposed on the bottom wall 1*a*, the stationary contact 2*a* being disposed in the center to function as a fulcrum for tilting a conductive plate 3. The conductive plate 3 is a metal plate with an M-shape from a side view, having a depressed portion 3*a* between two elevated portions 3*b* and 3*c*. One longitudinal end of the conductive plate 3 can move into and out of contact with the stationary contact 2*b*, while the other end has the same movement with the stationary contact 2*c*. An actuating portion 4*a* of a driver 4 is disposed on the conductive plate 3. A coil spring 5 causes the driver 4 to constantly apply force towards the bottom wall 1*a*, whereby the actuating portion 4*a* is in resilient contact with the conductive plate 3. The driver 4 and the coil spring 5 are mounted inside a housing 6*a* of a tilt lever 6. The tilt lever 6 is tiltably supported by a cover 7 which covers the case 1. An operating knob, which is not shown in FIG. 9, is attached to the tilt lever 6 by an appropriate method. An operator of the apparatus tilts the operating knob to move the tilt lever 6, thereby sliding the actuating portion 4*a* on the conductive plate 3.

FIG. 9 shows a neutral state (stand-by mode) where the tilt lever 6 is not being moved. In FIG. 9, the stationary contacts 2*a* and 2*c* are connected via the conductive plate 3, and the stationary contacts 2*a* and 2*b* are kept in an OFF mode. When the operating knob is pressed to tilt the lever 6 clockwise with respect to the drawing, the actuating portion 4*a* slides on the elevated portion 3*b* of the conductive plate 3 as the coil spring 5 becomes compressed. As the actuating portion 4*a* passes over the stationary contact 2*a*, the conductive plate 3 tilts counter-clockwise. As a result, the conductive plate 3 moves out of contact with the stationary contact 2*c* and moves into contact with the stationary contact 2*b* to create a state such that the stationary contacts 2*a* and 2*b* are connected via the conductive plate 3 to be switched to an ON mode. When the force applied from the operating knob is removed, the restoring force of the coil spring 5 causes the actuating portion 4*a* on the elevated portion 3*b* to slide in the opposite direction. This causes the actuating portion 4*a* to reversely pass over the stationary contact 2*a* to tilt the conductive plate 3 clockwise, whereby the switch device is switched back to the stand-by mode shown in FIG. 9. Consequently, the stationary contacts 2*a* and 2*b* are automatically switched back to an OFF mode.

If the tilt lever 6 is tilted counterclockwise in a stand-by mode shown in FIG. 9, the actuating portion 4*a* slides along the elevated portion 3*c*. However, since the conductive plate 3 is already pressed against the stationary contact 2*c* and therefore cannot be tilted, the stationary contacts 2*a* and 2*b* are kept disconnected to be in an OFF mode.

The switch devices of this type are extensively used as a driving switch for automatic window units in vehicles. In such a unit, a driving signal for opening and closing the window is output for the period of time that an operating knob is pressed, by which the window can be manually operated until the desired opening is obtained.

The above-mentioned conventional switch device has the driver 4 combined with the coil spring 5 on the conductive plate 3 and therefore requires a large housing 6*a* in the tilt lever 6. For this reason, the tilt lever 6 requires a reasonable height and may interfere with the achievement of a lower profile of the apparatus. Furthermore, the tilting movement requires a clearance space C between the tilt lever 6 and the cover 7. Through this space, foreign particles, such as dust, may enter and land on the contacts in the case 1, which may lead to a loss of reliability in the connections.

In a driving switch of an automatic window unit in a vehicle, two groups of the stationary contacts 2*a*, 2*b*, and 2*c* are disposed on the bottom wall 1*a* of the case 1 in a pair of rows, each group being provided with components such as the conductive plate 3 and the actuating portion 4*a* to form first and second switch elements. When the operating knob is pressed in one direction, the first switch element outputs a driving signal for opening, whereas pressing the knob in the other direction turns on the second switch element to output a driving signal for closing. To achieve such a double-pole double-throw switch device with the structure of the conventional apparatus as is shown in FIG. 9, the tilt lever 6 must be assembled with the case 1 and the cover 7 very carefully without misaligning the driver 4 and the coil spring 5. Such assembly process is extremely inefficient.

Also, in a driving switch of an automatic window unit in a vehicle, a function which enables the window to be fully opened or fully closed through one-touch operation is in demand, although adding this type of function to the conventional switch device would normally require a push switch in the vicinity of the case 1. In such a unit, when the tilt lever 6 is tilted with an operating knob, a single-purpose driving element presses the push switch to output a driving signal for a full-opening or a full-closing operation. However, if the driving element for the push switch is disposed outside the case 1 in a preferable position where the element can operate with respect to the timing of the movement of the driver 4, the whole apparatus may lead to a large-scale and a complex structure.

SUMMARY OF THE INVENTION

An object of the present invention is to solve the problems of the conventional switch devices and to provide a highly reliable switch device having a lower profile and more simple structure and being capable of ready assembly.

The switch device of the present invention includes a case with a bottom wall and a top opening; two switch elements assembled in the case; a common leaf spring whose restoring force is applied to the two switch elements; and a cover that presses a leaf spring and that covers the top opening. Each of the switch element includes stationary contacts that are fixed to the bottom wall of the case; a conductive plate that is disposed on the bottom wall and is tiltable to move into and out of contact with the stationary contacts; and a driver disposed on the conductive plate, the driver being rotatable around a shaft thereof and movable vertically. The driver includes a protruding receiver which protrudes from the case; and a sliding portion that slides on a slope of the conductive plate when the protruding receiver is pressed downward. The leaf spring includes a compressed portion which is resiliently compressed by the cover; and a pair of pressing strips which connect with the compressed portion and resiliently urge the shaft of the driver towards the bottom wall of the case.

With the pressing strip resiliently urging the shaft of the driver, the force applied by an operating knob to the protruding receiver moves the driver and causes the sliding portion to slide on the slope of the conductive plate. This allows the conductive plate to tilt and therefore excludes the need for an external driving element for tilting the conductive plate to move into and out of contact with the stationary contacts. Furthermore, the leaf spring can be disposed in the narrow space provided on the shafts of the drivers, whereby an apparatus with a lower profile can be readily achieved. The protruding receiver, which protrudes from the case, can turn on the push switch in the vicinity of the case when the operating knob is pressed with a great force to achieve a multifunctional apparatus. The additional driving element for the push switch therefore is not necessary, leading to a low-profile apparatus with a more simple, compact structure. After the conductive plates and the drivers include in the two switch elements are disposed onto the bottom wall, the leaf spring and the cover are disposed onto the switch elements, whereby the one common leaf spring applies a restoring force to both of the switch elements. This enables an automatic assembly of the apparatus. Furthermore, because the top opening of the case is covered with the cover, the case is protected from foreign dust particles, maintaining reliability in the connections for a longer period of time.

In this structure, the compressed portion of the leaf spring includes first bent strips formed of sharply bent first longitudinal end segments extending from the pressing strips, the first longitudinal end segments being bridged; and a second bent strip formed of sharply bent second longitudinal end segments extending from the pressing strips, the second longitudinal end segments being bridged. The cover is mounted above the leaf spring disposed at the top of the case and resiliently urges the first and the second bent strips. Thus, a resilient force is applied towards the pressing strips to create a spring force therein. The leaf spring, which applies its restoring force to the switch elements, has a simple, low-profile structure and contributes to lower costs of the parts as well as a lower profile apparatus.

The structure includes sidewalls orthogonal to the bottom wall for determining the longitudinal position of the pressing strips, and guides in the shafts of the drivers for determining the lateral position. Thus, the positioning of the leaf spring at the top of the case can be performed during the assembly, as well as preventing the misalignments of the components. Accordingly, the automatic assembly becomes easier and greatly reduces the assembly costs.

In plan view, this structure may preferably have the two switch elements including the stationary contacts, the conductive plate, and the driver being disposed point-symmetrically so that the apparatus may have a smaller size.

The present invention discloses a switch device which is driven when an operating knob is directly pressed against drivers, the drivers then being generated a tilting movement to tilt conductive plates so that the apparatus can be turned on. Since a leaf spring is disposed in narrow spaces provided on shafts of the drivers, an apparatus with a low profile can be readily achieved. Furthermore, in the assembly of this switch device, the conductive plates and the drivers composing the two switch elements are mounted on a bottom wall of a case, and the leaf spring and a cover are then mounted on the switch elements, whereby both of the switch elements receive the restoring force of one common leaf spring. Thus, a highly efficient, automatic assembly of the apparatus can be achieved. Furthermore, because a top opening of the case is covered with the cover, the case is protected from foreign dust particles to maintain reliability in the connections for a longer period of time.

DESCRIPTION OF THE PREFERRED EMBODIMENTS

Figure 1:
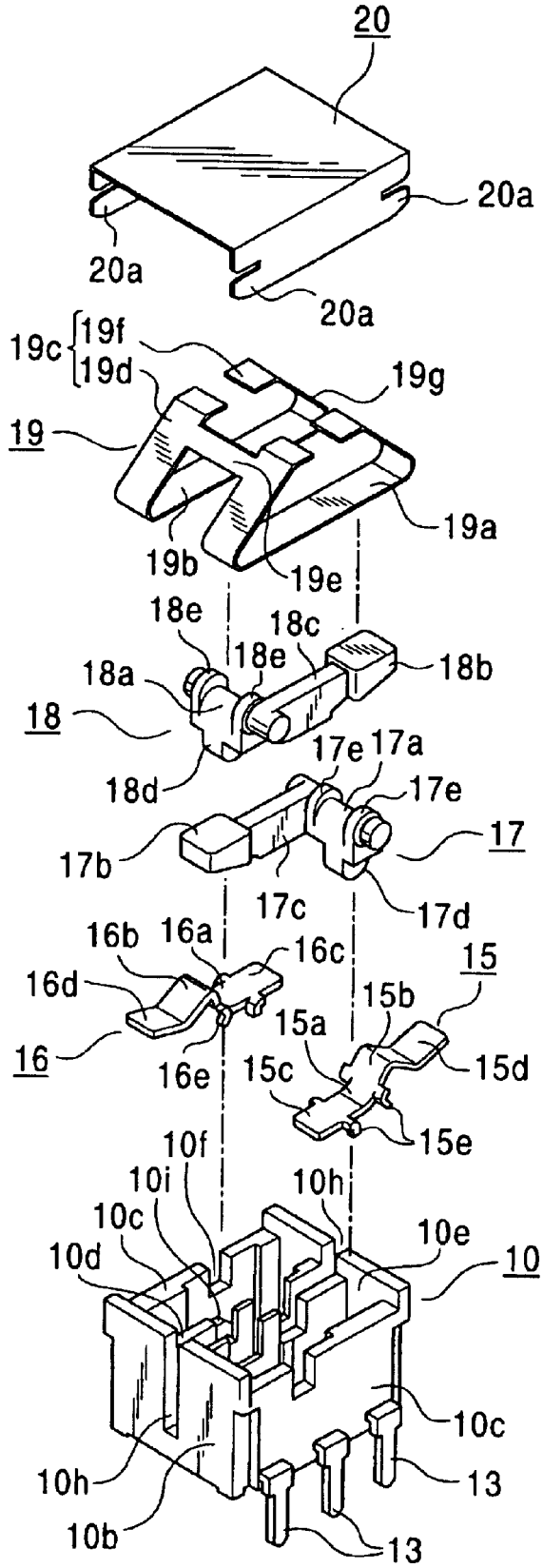
FIG. 1 is an exploded perspective view of a switch device according to an embodiment of the present invention.
Figure 2:
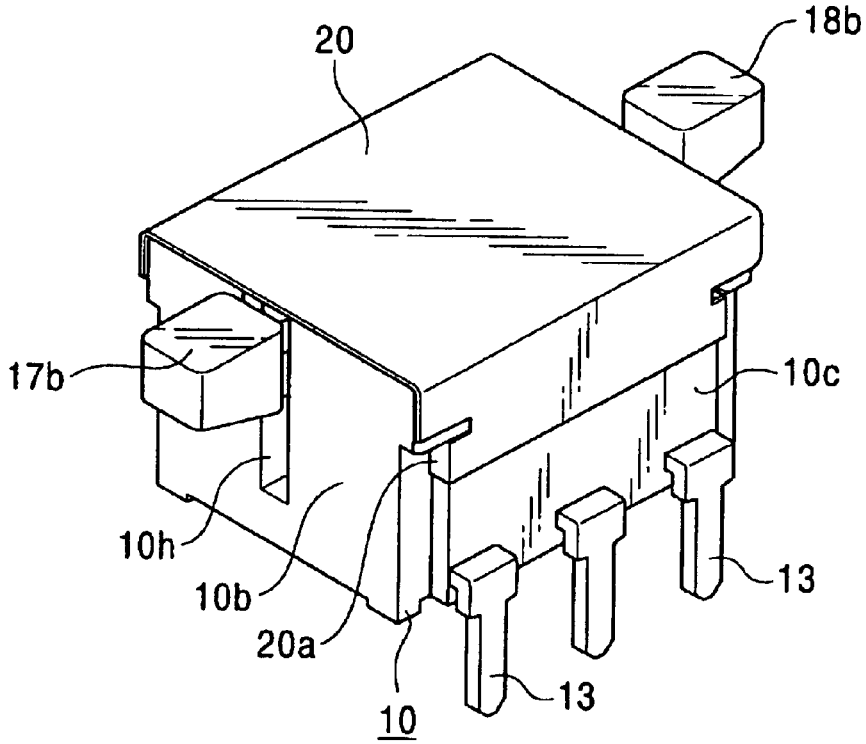
FIG. 2 is a perspective view of the switch device when an operating knob is not mounted thereon.
Figure 3:
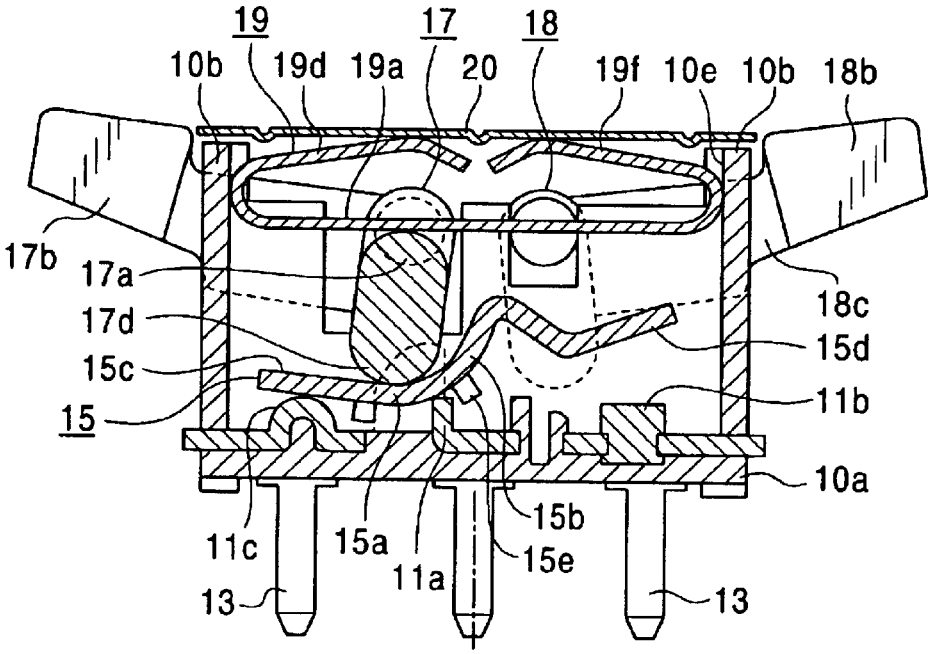
FIG. 3 is a sectional view of the switch device shown in FIG. 2.
Figure 4:
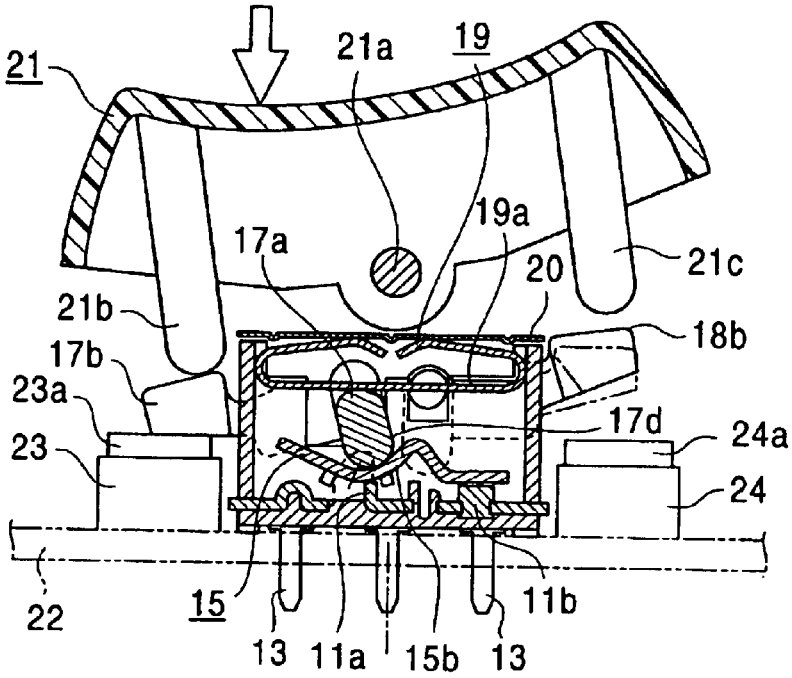
FIG. 4 is a diagram illustrating the operation of the switch device.
Figure 5:
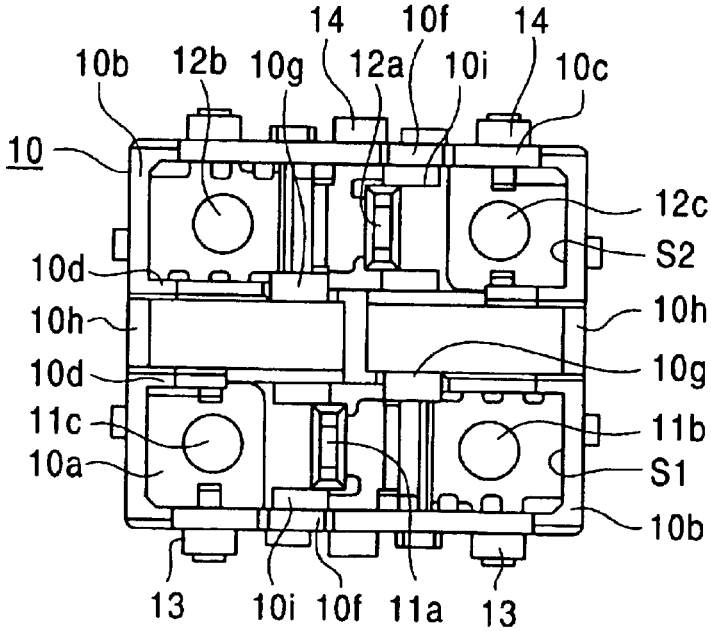
FIG. 5 is a plan view of a case serving as an enclosure of the switch device.
Figure 6:
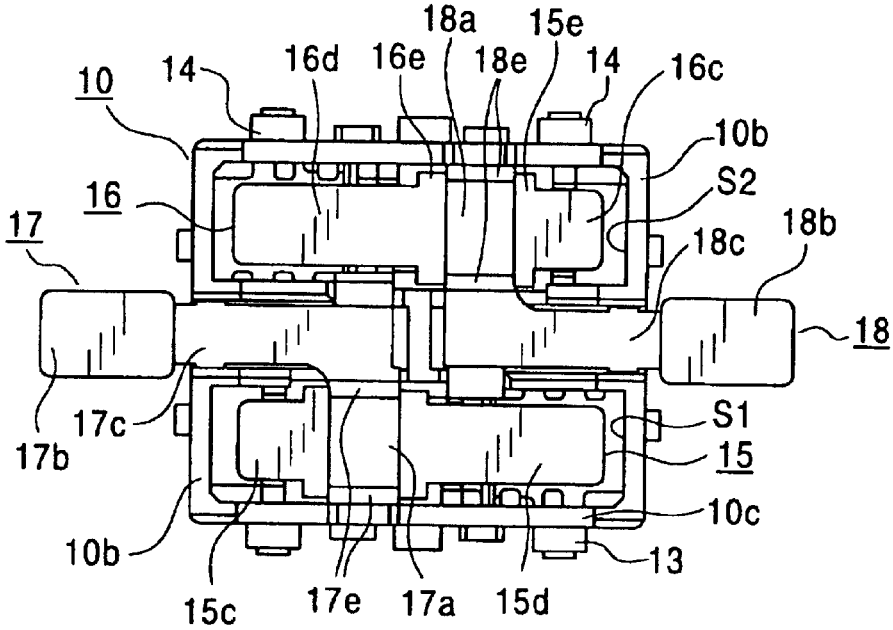
FIG. 6 is a plan view of the switch device when conductive plates and drivers are disposed in the case.
Figure 7:
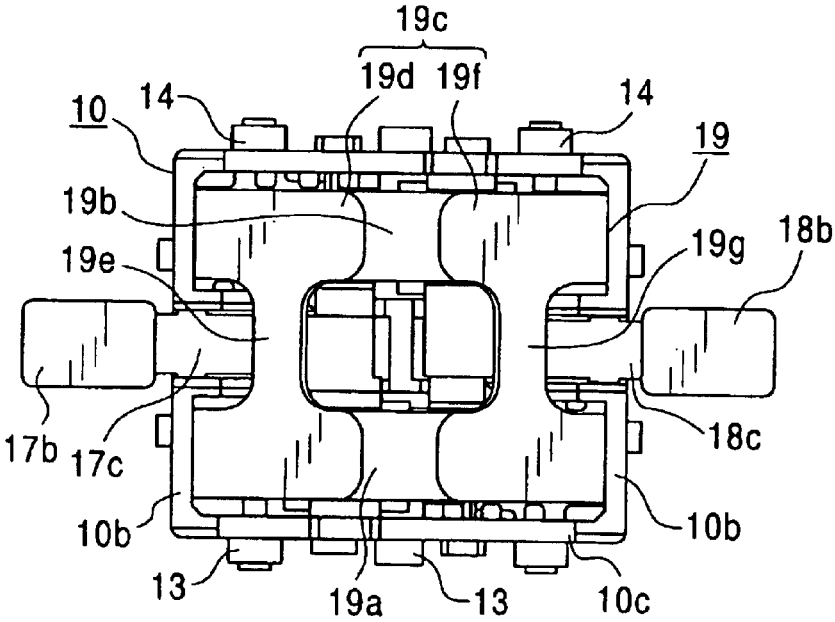
FIG. 7 is a plan view of the switch device shown in FIG. 6 when a leaf spring is further mounted in the case.
Figure 8:
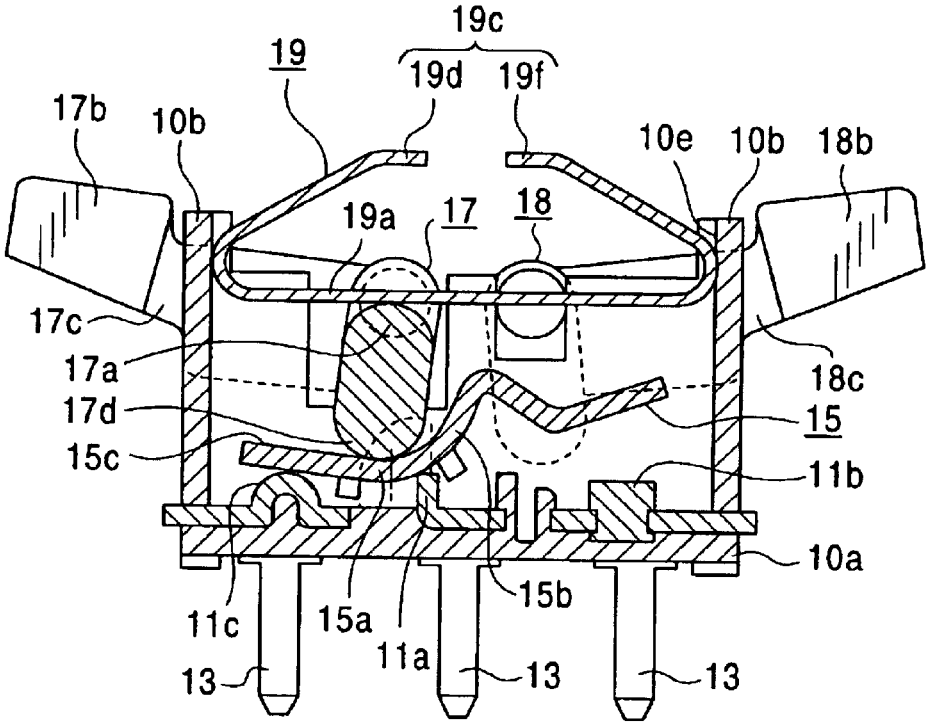
FIG. 8 is a sectional view of the switch device shown in FIG. 7.
Figure 9:
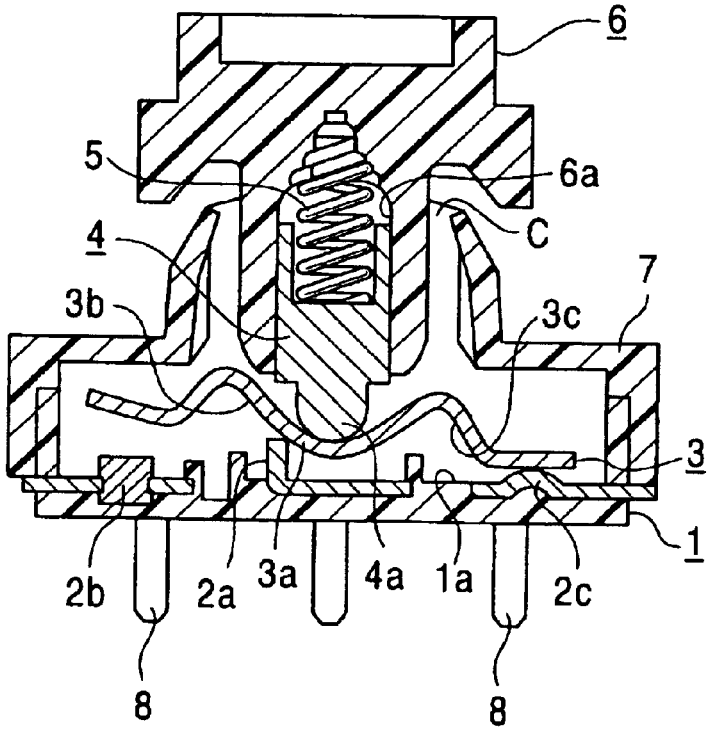
FIG. 9 PRIOR ART
FIG. 9 is a sectional view of a conventional switch device.

The preferred embodiments according to the present invention will be described with reference to the drawings. FIG. 1 is an exploded perspective view of a switch device according to an embodiment of the present invention. FIG. 2 is a perspective view of the switch device when an operating knob is not mounted thereon. FIG. 3 is a sectional view of the switch device shown in FIG. 2. FIG. 4 is a diagram illustrating the operation of the switch device. FIG. 5 is a plan view of a case serving as an enclosure of the switch device. FIG. 6 is a plan view of the switch device when conductive plates and drivers are disposed in the case. FIG. 7 is a plan view of the switch device shown in FIG. 6 when a leaf spring is further mounted in the case. FIG. 8 is a sectional view of the switch device shown in FIG. 7.

The switch device shown in the drawings is a double-pole double-throw switch having two switch elements and is used as a driving switch in an automatic window unit in a vehicle.

The switch device mainly includes a case 10 having sidewalls 10*b* and 10*c* and dividers 10*d* orthogonal to a bottom wall 10*a* to form a pair of spaces S1 and S2 for housing contacts; a first group of contacts consisting of stationary contacts 11*a*, 11*b*, and 11*c* and a second group of contacts consisting of stationary contacts 12*a*, 12*b*, and 12*c*, both groups of contacts being insert-molded on the bottom wall 10*a* of the case 10; three terminals 13 which extend from the stationary contacts 11*a*, 11*b*, and 11*c* and protrude downward from the case 10; three terminals 14 which extend from the stationary contacts 12*a*, 12*b*, and 12*c* and protrude downward from the case 10; a pair of conductive plates 15 and 16 tiltably disposed on the bottom wall 10*a* in the spaces S1 and S2, respectively; a pair of drivers 17 and 18 disposed on the plates 15 and 16, respectively, the drivers 17 and 18 being rotatable around shafts 17*a* and 18*a* thereof and movable vertically; a leaf spring 19 having a pair of pressing strips 19*a* and 19*b* which resiliently urge the shafts 17*a* and 18*a* toward the bottom wall 10*a*; a metal plate cover 20 attached to the case 10 to cover a top opening 10*e* of the case 10; and an operating knob 21 supported by a knob fulcrum 21*a* around which the knob 21 can move in a tilting motion. Referring to FIG. 4, the operating knob 21 includes downward pressing projections 21*b* and 21*c* that are in resilient contact with respective protruding receivers 17*b* and 18*b* of the drivers 17 and 18. The switch device is mounted on a circuit board 22 that includes a pair of push switches 23 and 24 near the case 10. The push switches 23 and 24 have upper pads 23*a* and 24*a*, respectively, disposed below the protruding receivers 17*b* and 18*b*.

The case 10 includes the two parallel longitudinal sidewalls 10*c*, the four dividers 10*d*, and the two lateral sidewalls 10*b* perpendicular to the sidewalls 10*c*. Each of the sidewalls 10*c* and 10*c* and the dividers 10*c* is orthogonal to the bottom wall 10*a*. Referring to FIGS. 1 and 5, the two sidewalls 10*c* have notches 10*f* on the upper edges (near the top opening 10*e*), and two of the dividers 10*d* have notches 10*g* on the upper edges. Both axial ends of the drivers 17 and 18 are disposed in the notches 10*f* and 10*g* and can be moved vertically therein. In other words, the axial ends of the driver 17 are disposed in the notches 10*f* and 10*g* in the left half of the drawing in FIG. 5, whereas the axial ends of the driver 18 are disposed in the notches 10*f* and 10*g* in the right half. The two lateral sidewalls 10*b* each have an opening extending from the top edge through the center to form a slit 10*h*. These slits 10*h* hold arms 17*c* and 18*c* of the drivers 17 and 18 and allow the arms 17*a* and 18*a* to move vertically. Furthermore, the sidewalls 10*c* are provided with projections 10*i* on the inner surfaces, and the dividers 10*d* are also provided with projections 10*i* on the surfaces facing the sidewalls 10*c*. The upper corners of these projections 10*i* are rounded so that the conductive plates 15 and 16 can be smoothly positioned during assembly.

The stationary contacts 11*a* to 11*c*, which are aligned on the bottom surface of the space S1, include a first stationary contact 11*a* in permanent contact with the conductive plate 15 and serving as a fulcrum, a second stationary contact 11*b*, and a third stationary contact 11*c*, both contacts 11*b* and 11*c* capable of being in contact with or out of contact with the conductive plate 15. Similarly, the stationary contacts 12*a* to 12*c*, which are aligned on the bottom surface of the space S2 of the case 10, include a first stationary contact 12*a* in permanent contact with the conductive plate 16 serving as a fulcrum, a second stationary contact 12*b*, and a third stationary contact 12*c*, both contacts 12*b* and 12*c* capable of being in contact with or out of contact with the conductive plate 16. It should be noted that the first group of contacts 11*a* to 11*c* and the second group of contacts 12*a* to 12*c* are disposed point-symmetrically to each other in plan view. The three terminals 13 extending from the stationary contacts 11*a* to 11*c* and the three terminals 14 extending from the stationary contacts 12*a* to 12*c* are all connected to an external circuit.

Referring to FIGS. 1 and 3, the conductive plate 15 is a metal plate and includes an initial holding portion 15*a* that supports the driver 17 when the operating knob 21 is not mounted; an elevated portion 15*b* having a reversed V-shape from a side view, and serving as a slope extending from one end of the holding portion 15*a*; a flat portion 15*c* extending from the other end of the holding portion 15*a*; and a movable contact 15*d* extending from the elevated portion 15*b* away from the holding portion 15*a*. The movable contact 15*d* moves into and out of contact with the stationary contact 11*b*, and the flat portion 15*c* has the same movement with the stationary contact 11*c*. Furthermore, the conductive plate 15 has four lugs 15*e*, two of the lugs being provided on one edge of the holding portion 15*a* and the other two lugs being provided on the other edge. The lugs 15*e* are engaged with the corresponding projections 10*i* of the case 10 to prevent longitudinal dislocation of the conductive plate 15 during the tilting motion. The conductive plate 16, which has the same shape as that of the conductive plate 15, includes an initial holding portion 16*a*; an elevated portion 16*b* on one end of the holding portion 16*a*; a flat portion 16*c* on the other end of the holding portion 16*a*; and a movable contact 16*d* extending in one longitudinal direction. The movable contact 16*d* moves into and out of contact with the stationary contact 12*b*, and the flat portion 16*c* extending in the other longitudinal direction has the same movement with the stationary contact 12*c*. The conductive plate 16 has four lugs 16*e*, two of the lugs being provided on one edge of the holding portion 16*a* and the other two lugs being provided on the other edge. The lugs 16*e* are engaged with the corresponding projections 10*i* of the case 10 to prevent longitudinal dislocation of the conductive plate 16 during the tilting motion. Referring to FIG. 6, the conductive plates 15 and 16 are disposed point-symmetrically with each other in the case 10 in a plan view.

The driver 17 includes a sliding portion 17*d* which extends downward from the shaft 17*a* to sit on the conductive plate 15; the arm 17*c* which laterally extends adjacent to the shaft 17*a* to be disposed in a first slit 10*h*; the protruding receiver 17*b* provided on the end of the arm 17*c* to protrude from the sidewalls 10*b*; and a pair of guides 17*e* protruding from the shaft 17*a* to face each other over a predetermined distance. Similarly, the driver 18 includes a sliding portion 18*d* which extends downward from the shaft 18*a* to sit on the conductive plate 16; the arm 18*c* which extends laterally adjacent to the shaft 18*a* to be disposed in the second slit 10*h*; the protruding receiver 18*b* provided on the end of the arm 18*c* to protrude from the sidewalls 10*b*; and a pair of guides 18*e* protruding from the shaft 18*a* to face each other over a predetermined distance. Referring to FIG. 6, the drivers 17 and 18 are disposed point-symmetrically to each other in the case 10 in plan view, thereby aligning the two arms 17*c* and 18*c* in a straight line. In other words, the drivers 17 and 18 are arranged in the case 10 in a state such that the arms 17*c* and 18*c* are disposed in a narrow space between the spaces S1 and S2 of the case 10, and that the protruding receivers 17*b* and 18*b* protrude through the pair of slits 10*h* which face each other in the longitudinal direction of the narrow space. Furthermore, the axial ends of the driver 17 are engaged with one pair of notches 10*f* and 10*g*, while the axial ends of the driver 18 are engaged with the other pair of notches 10*f* and 10*g* so that the drivers 17 and 18 can easily be disposed in the predetermined positions on the corresponding conductive plates 15 and 16.

The leaf spring 19 is formed by press-working a single metal spring plate into the shape shown in FIG. 1. The leaf spring 19 has a pair of parallel pressing strips 19*a* and 19*b* which are connected to the compressed portion 19*c* to form a substantial trapezoidal shape from a side view. The pair of pressing strips 19*a* and 19*b* resiliently urges the shafts 17*a* and 18*a* towards the bottom wall 10*a*. The cover 20 compresses the compressed portion 19*c* to create a spring force in the pressing strips 19*a* and 19*b*. The compressed portion 19*c* includes a first bent strip 19*d* having sharply bent first longitudinal end segments extending from the pressing strips 19*a* and 19*b*, and a bridge 19*e* that bridges the end segments to form a substantially H-shape; and a second bent strip 19*f* having sharply bent second longitudinal end segments extending from the pressing strips 19*a* and 19*b*, and a bridge 19*g* that bridges the end segments to form a substantially H-shape. Referring to FIGS. 7 and 8, the leaf spring 19 is disposed at the top of the case 10 during assembly so that one pressing strip 19*a* is disposed on the shaft 17*a* of the driver 17 and the other pressing strip 19*b* is disposed on the shaft 18*a* of the driver 18. During assembly, the pressing strip 19*a* is fitted between the two guides 17*e* and the pressing strip 19*b* is fitted between the two guides 18*e* to position the leaf spring 19 laterally. Furthermore, the longitudinal length of the leaf spring 19 may be set substantially equal to the length between the two sidewalls 10*b* so that the pressing strips 19*a* and 19*b* of the leaf spring 19 can be positioned longitudinally. Thus, the leaf spring 19 can be easily and securely assembled into the predetermined position in the case 10.

The cover 20 is provided with mounting tabs 20*a* at the lower four corners, and is attached to the case 10 by bending the tabs 20*a* into engagement with the four corners of the case 10 to cover the top opening 10*e*. Thus, the cover 20 attached to the case 10 causes the pre-mounted leaf spring 19 in the case 10 to be resiliently deformed from the state in FIG. 8 to the state in FIG. 3. In detail, when the cover 20 is mounted above the leaf spring 19 disposed at the top of the case 10, the cover 20 resiliently urges the first bent strip 19*d* and the second bent strip 19*f*. Thus, the resilient force is applied towards the pressing strips 19*a* and 19*b* to create a spring force therein. The spring force causes one pressing strip 19*a* to resiliently urge the shaft 17*a* towards the bottom wall 10*a*, thereby causing the sliding portion 17*d* to resiliently contact the conductive plate 15. Rotating the driver 17 around the shaft 17*a*, therefore, causes the sliding portion 17*d* to slide on the conductive plate 15, also causing the conductive plate 15 to tilt. Similarly, the same spring force causes the other pressing strip 19*b* to resiliently urge the shaft 18*a* towards the bottom wall 10*a*, thereby causing the sliding portion 18*d* to resiliently contact the conductive plate 16. Rotating the driver 18 around the shaft 18*a*, therefore, causes the sliding portion 18*d* to slide on the conductive plate 16, also causing the conductive plate 16 to tilt.

The switch device described above includes a first switching element having the space S1 for housing components such as the stationary contacts 11*a* to 11*c*, the conductive plate 15, the driver 17, and the pressing strip 19*a*; and a second switching element having the space S2 for housing components such as the stationary contacts 12*a* to 12*c*, the conductive plate 16, the driver 18, and the pressing strip 19*b*. The first and second switching elements are arranged in parallel in the case 10 and receives the restoring force of one common leaf spring 19.

When the switch device is installed in an automatic window unit in a vehicle, the operating knob 21 (with reference to FIG. 4) is mounted on the top of the case 10. In this mounting process, the pair of pressing projections 21*b* and 21*c* of the operating knob 21 are brought into resilient contact with the respective protruding receivers 17*b* and 18*b* to create a pretension which eliminates the backlash between the operating knob 21 and the drivers 17 and 18. In such a pretension state, the sliding portions 17*d* and 18*d* are positioned near the bottom of the slopes of the respective elevated portions 15*b* and 16*b*. When the operating knob 21 is removed, as is shown in FIG. 3, the sliding portions 17*d* and 18*d*, respectively, come into contact with the initial holding portions 15*a* and 16*a* to slightly raise the protruding receivers 17*b* and 18*b*. The movement of the drivers 17 and 18 from the state in FIG. 3 to the pre-tension state may be estimated to determine the initial positions of the drivers 17 and 18 and the shapes of the conductive plates 15 and 16. This estimation facilitates a structure that allows the protruding receivers 17*b* and 18*b* to have a large vertical motion when the sliding portions 17*d* and 18*d* slide on the conductive plates 15 and 16.

The operation of the switch device including the above components will now be described. In the stand-by mode free of an operating force (the pre-tension state described previously), the sliding portion 17*d* of the driver 17 is in resilient contact with the bottom slope of the elevated portion 15*b* of the conductive plate 15. Hence, the stationary contacts 11*a* and 11*c* are electrically connected via the conductive plate 15, whereas the stationary contacts 11*a* and 11*b* remain in an OFF mode. In the same manner, the sliding portion 18*d* of the driver 18 is in resilient contact with the bottom slope of the elevated portion 16*b* of the conductive plate 16. Hence, the stationary contacts 12*a* and 12*c* are electrically connected via the conductive plate 16, whereas the stationary contacts 12*a* and 12*b* remain in an OFF mode.

When force is applied to the operating knob 21, as is shown with the arrow in FIG. 4, the pressing projection 21*b* presses the protruding receiver 17*b* of the driver 17. As the receiver 17*b* is pressed, the arm 17*c* moves counterclockwise in the drawing. The sliding portion 17*d* then slides upward along the slope of the elevated portion 15*b* of the conductive plate 15. Finally, the shaft 17*a* is slightly raised against the pressing strip 19*a*. The sliding portion 17*d* then passes over the stationary contact 11*a* and tilts the conductive plate 15, resulting in the state shown in FIG. 4. As a result, the flat portion 15*c* moves out of contact with the stationary contact 11*c* while the movable contact 15*d* contacts the stationary contact 11*b*. The stationary contacts 11*a* and 11*b* are thus electrically connected, whereby a switch ON signal (a driving signal for opening a window) is output from the terminals 13.

When the operating force is removed from the operating knob 21 in the state shown in FIG. 4, the restoring force of the pressing strip 19*a* is applied to the shaft 17*a* of the driver 17, and thereby sliding the sliding portion 17*d* downward along the slope of the elevated portion 15*b*. When the sliding portion 17*d* reversely passes over the stationary contact 11*a*, the conductive plate 15 is tilted in reverse, that is, counterclockwise in the drawing, and the pressing projection 21*b* is pressed upward by the protruding receiver 17*b*. As a result, the movable contact 15*d* moves out of contact with the stationary contact 11*b* while the flat portion 15*c* moves into contact with the stationary contact 11*c*. The stationary contacts 11*a* and 11*b* are thus disconnected, whereby a switch OFF signal is output from the terminals 13 and the stand-by mode in which the operating knob 21 is substantially horizontal is recovered.

Another feature of the operation of this apparatus will be described. When the operating knob 21 is further pressed in the state of FIG. 4, the sliding portion 17*d* slides further along the elevated portion 15*b*, whereby the shaft 17*a* receives a greater resilient force from the pressing strip 19*a*. With the protruding receiver 17*b* being further pressed downward by the pressing projection 21*b*, the receiver 17*b* pushes the upper pad 23*a* to turn on the push switch 23. The push switch 23 then outputs a driving signal for fully opening the window. When the operating force is removed from the operating knob 21 in this state, the force of the pressing strip 19*a* causes the sliding portion 17*d* to slide downward along the slope of the elevated portion 15*b*, thereby hanging back to the state in FIG. 4 and then to the stand-by mode.

When the operating knob 21 is tilted in the stand-by mode so as to push the pressing projection 21*c* against the protruding receiver 18*b* of the driver 18, the arm 18*c* moves and the sliding portion 18*d* slides upward along the slope of the elevated portion 16*b*. This causes the shaft 18*a* to be pressed against the pressing strip 19*b* and allows the sliding portion 18*d* to pass over the stationary contact 12*a* to tilt the conductive plate 16. The stationary contacts 12*a* and 12*b* are thus electrically connected, and a switch ON signal (a driving signal for closing the window) is output from the terminals 14. When the operating knob 21 is further pressed, the pressing projection 21*c* pushes the upper pad 24*a* via the protruding receiver 18*b*, thereby allowing the push switch 24 to be turned on to output a driving signal for fully closing the window. When the operating force is removed, the resilient force of the pressing strip 19*b* causes the sliding portion 18*d* to slide downward along the slope of the elevated portion 16*b*. As a result, the conductive plate 16 is tilted in reverse while the protruding receiver 18*b* pushes the pressing projection 21*c* upward to be changed back to the stand-by mode.

As described above, the switch device of this embodiment allows the operating knob 21 to directly press against the drivers 17 and 18 and therefore does not require other intermediate driving elements. Furthermore, the leaf spring 19 disposed in the narrow space on the shafts 17*a* and 18*a* can provide an apparatus with a lower profile. In this apparatus, the push switches 23 and 24 is turned on when the protruding receivers 17*b* and 18*b* are pressed with the operating knob 21, enabling an operation without an external driving element for the push switches. Furthermore, this multifunctional apparatus performs manual operation as well as full-opening and full-closing operations and accomplishes compactness and low profile without having a complex structure.

In the assembly of this switch device, the conductive plates 15 and 16 and the drivers 17 and 18 composing the two switch elements are mounted on the bottom wall 10*a* of the case 10, and the leaf spring 19 and the cover 20 are then mounted on the switch elements. This assembly process is efficient. Furthermore, during the mounting of the cover 20, the compressed portion 19*c* of the leaf spring 19 is urged by the cover 20, creating spring forces in the pressing strips 19*a* and 19*b*. Consequently, both of the switch elements receive the restoring force of one common leaf spring 19. The positioning of the conductive plates 15 and 16 with the projections 10*i* in the case 10, the positioning of the drivers 17 and 18 with the notches 10*f* and 10*g* and with the slits 10*h*, and the positioning of the leaf spring 19 with the sidewalls 10*c* and with the guides 17*e* and 18*e* in the drivers 17 and 18 during the assembly enables automatic assembly of the apparatus without misalignment of components. Thus, the assembly costs can be greatly reduced. Since the top opening 10*e* of the case 10 is covered with the cover 20, the switch device is protected from the entry of foreign dust particles into the case 10, preventing poor connection and short circuiting to achieve a high reliability of the apparatus for a longer period of time.

In the switch device of this embodiment, the two switch elements are arranged point-symmetrically in plan view. Specifically, all the stationary contacts 11*a* to 11*c* and the stationary contacts 12*a* to 12*c*, the conductive plate 15 and conductive plate 16, and the driver 17 and the driver 18 are arranged point-symmetrically. This contributes to the compactness of the apparatus for effectively using the spaces provided in the case 10. Furthermore, the sidewalls 10*c* and the dividers 10*d* are provided with the notches 10*f* and 10*g* in which the axial ends of the drivers 17 and 18 are fitted and can move vertically, and the sidewalls 10*b* have slits 10*h* in which the arms 17*c* and 18*c* are fitted and can move vertically, thereby maintaining the space for moving the drivers 17 and 18 while minimizing the height of the case 10.

The switch device of this embodiment has a structure in which the driver 17 is disposed between the conductive plate 15 and the pressing strips 19*a*, and the driver 18 is disposed between the conductive plate 16 and the pressing strip 19*b*. This structure allows the sliding portions 17*d* and 18*d*, respectively, to resiliently contact the conductive plates 15 and 16, and also allows the protruding receivers 17*b* and 18*b*, respectively, to resiliently contact the pressing projections 21*b* and 21*c*. Accordingly, the leaf spring 19 resiliently urges the shafts 17*a* and 18*a* towards the conductive plates 15 and 16. When force is not applied on the operating knob 21, a resilient force tries to move the sliding portions 17*d* and 18*d* downward along the slope of the elevated portions 15*b* and 16*b*, causing the protruding receivers 17*b* and 18*b* to resiliently bias upward against the pressing projections 21*b* and 21*c* of the operating knob 21. On the other hand, when force is applied on the operating knob 21, the pressing projection 21*b* (or 21*c*) directly presses the protruding receiver 17*b* (or 18*b*) to move the sliding portion 17*d* (or 18*d*) on the conductive plate 15 (or 16), whereas the removal of the force on the operating knob 21 causes the protruding receiver 17*b* (or 18*b*) to press against the operating knob 21. In this manner, the backlashes between the operating knob 21 and the drivers 17 and 18 are prevented during operation, thereby always achieving a good manipulation of the apparatus.

What is claimed is:

1. A switch device comprising:

a case having a bottom wall and a top opening;

two switch elements assembled in the case;

a common leaf spring whose restoring force is applied to the two switch elements; and a cover that presses the leaf spring and covers the top opening;

wherein each of the switch elements comprises:

stationary contacts that are fixed to the bottom wall of the case;

a conductive plate that is disposed on the bottom wall and is tiltable to move into and out of contact with the stationary contacts; and a driver disposed on the conductive plate, the driver being rotatable around a shaft thereof and movable vertically;

wherein the driver comprises:

a protruding receiver which protrudes from the case; and a sliding portion that slides on a slope of the conductive plate when the protruding receiver is pressed downward; and wherein the leaf spring comprises:

a compressed portion which is resiliently compressed by the cover; and a pair of pressing strips which connect with the compressed portion and resiliently urges the shaft of the driver towards the bottom wall of the case.

2. The switch device according to claim 1, wherein the compressed portion of the leaf spring comprises first bent strips formed of sharply bent first longitudinal end segments extending from the pressing strips, the first longitudinal end segments being bridged; and second bent strips formed of sharply bent second longitudinal end segments extending from the pressing strips, the second longitudinal end segments being bridged.

3. The switch device according to claim 1, wherein the case further has sidewalls, orthogonal to the bottom wall, for determining a longitudinal position of the pressing strips, and the driver further comprises guides on the shaft for determining a lateral position of the pressing strips.

4. The switch device according to claim 1, wherein the two switch elements are disposed point-symmetrically in plan view.

* * * * *